United States Patent [19]

Hamilton

[11] Patent Number: 4,489,955

[45] Date of Patent: Dec. 25, 1984

[54] WHEELCHAIR

[75] Inventor: W. Duane Hamilton, Southbridge, Mass.

[73] Assignee: N. A. Taylor Company, Inc., Gloversville, N.Y.

[21] Appl. No.: 447,987

[22] Filed: Dec. 8, 1982

[51] Int. Cl.[3] ..... A61G 5/02

[52] U.S. Cl. ..... 280/242 WC; 188/2 F; 297/16; 297/378; 297/DIG. 4; 301/132

[58] Field of Search ..... 280/242 WC, 661, 719, 280/289 WC; 297/16, 36, 53, 378, DIG. 4; 180/DIG. 3; 188/2 F, 20, 24.11, 24.21, 24.22; 301/132

[56] References Cited

U.S. PATENT DOCUMENTS

| | | | |
|---|---|---|---|
| 2,561,616 | 7/1951 | Everest et al. | 280/47.39 |
| 2,782,835 | 2/1957 | Liebich | 280/47.39 |
| 3,401,981 | 9/1968 | Adams | 301/132 |
| 3,679,257 | 7/1972 | Jacuzzi et al. | 297/42 |
| 3,893,708 | 7/1975 | Moroney | 280/242 WC |
| 3,917,312 | 11/1975 | Rodaway | 280/242 WC |
| 3,952,822 | 4/1976 | Udden et al. | 180/DIG. 3 |
| 3,994,509 | 11/1976 | Schaeffer | 280/242 WC |
| 4,166,631 | 9/1979 | Sanaski | 280/242 WC |
| 4,204,588 | 5/1980 | Kawecki | 188/2 F |
| 4,231,589 | 11/1980 | Hodgkins et al. | 280/781 |
| 4,234,228 | 11/1980 | Flamm | 297/464 |
| 4,350,227 | 9/1982 | Knoche | 188/2 F |
| 4,351,540 | 9/1982 | Minnebraker | 280/242 WC |
| 4,358,125 | 11/1982 | Charles | 280/242 WC |
| 4,360,213 | 11/1982 | Rudwick et al. | 280/242 WC |
| 4,362,311 | 12/1982 | Bergman | 280/242 WC |
| 4,405,142 | 9/1983 | Whetstine | 280/242 WC |

FOREIGN PATENT DOCUMENTS 8103610 12/1981 European Pat. Off. .

*Primary Examiner*—John A. Pekar

*Attorney, Agent, or Firm*—Cushman, Darby & Cushman

[57] ABSTRACT

A wheelchair, for either street or sports (e.g. racing) use, is comfortable and easy-to-use, lightweight, and may be folded compactly for transportation. A plastic pallet supports a collapsible chair frame, and is mounted to a base frame for adjustment along the base frame to thereby adjust the center of gravity of the wheelchair. The rear drive wheels and the caster-type front wheels are both mounted to the frame for easy removal, utilizing a split-block receiving the spindle or shaft from the wheels. The blocks may be pivoted about axes perpendicular to the axes of rotation of the rear wheels to adjust the camber of the wheels, and—by effecting flexing of a leaf spring to which the blocks are mounted—the toe of the rear wheels may be adjusted.

19 Claims, 16 Drawing Figures

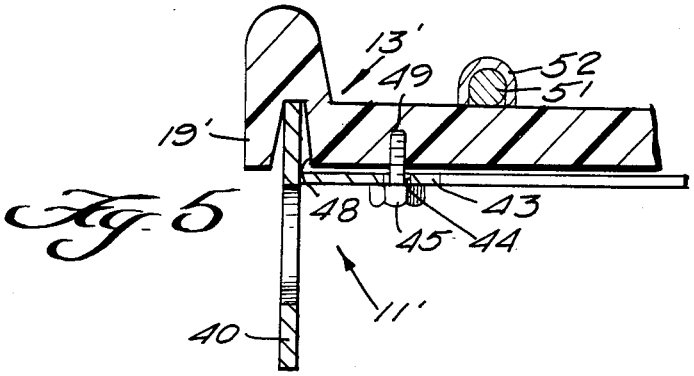
Fig. 5
Fig. 6
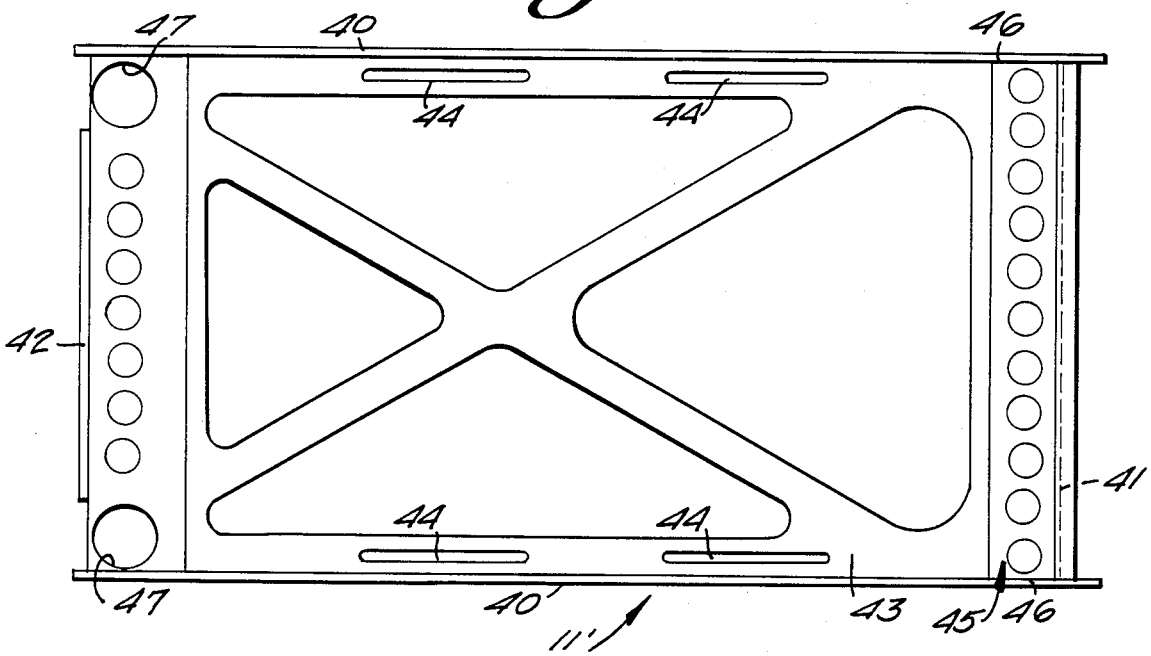
Fig. 7
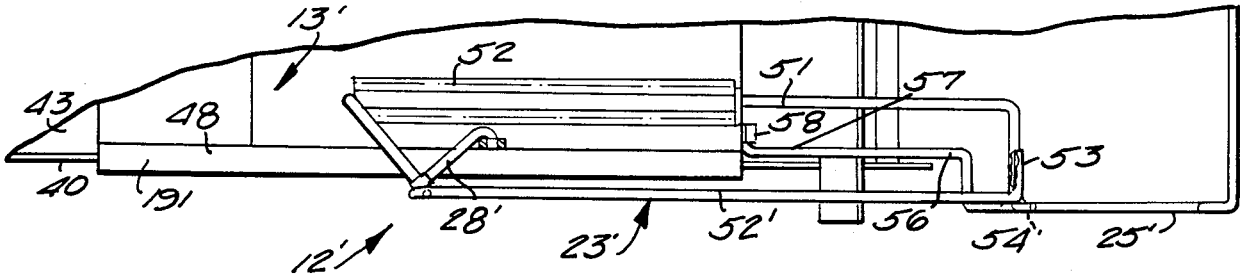

WHEELCHAIR

BACKGROUND AND SUMMARY OF THE INVENTION

There has been a tendency in the past to look on wheelchairs as merely a means for providing limited transportation for invalids within a relatively small area. However with increasing opportunities for mobility by wheelchair users, and an increasing interest in sports activities in which the wheelchair user may participate, there has arisen a need for wheelchairs that—while comfortable and easy to use—are capable of being folded compactly for transportation in a car or plane, are lightweight, can accommodate the particular physical characteristics of the user, and are readily maneuverable for use in wheelchair sports. The wheelchair according to the present invention is one that fulfills such a need.

The wheelchair according to the present invention is constructed in a modular format. A base frame mounts the wheels, preferably comprising two rear drive wheels and two front caster-type wheels. The frame receives a pallet, and the pallet in turn supports a collapsible chair frame. The position of the pallet with respect to the frame can be easily adjusted to adjust the center of gravity of the wheelchair without repositioning the rear wheels vis-a-vis the frame. The chair frame can collapse into a substantially flat configuration on the pallet for ease of transportation. All wheels are connected to the frame utilizing a split-block construction that allows for ready removal of the wheels while insuring that they are maintained properly in place during use.

In order to maximize the maneuverability and versatility of the wheelchair according to the invention, toe and camber adjustments for the drive wheels are provided. The split-blocks that receive the spindles, or other shaft means, of the drive wheels are mounted for pivotal movement about an axis perpendicular to the axis of rotation of the rear wheels, to adjust the camber of the rear wheels. The blocks are mounted on the free ends of a leaf spring which is stationarily mounted to the frame at a central portion thereof. By flexing the ends of the leaf spring with respect to the frame, the toe of the drive wheels may also be readily adjusted.

Since ready removal of the drive wheels is desirable, the brake that is provided is mounted for pivotal movement about an axis generally parallel to the axis of rotation of the drive wheels so that the brake mechanism can be pivoted out of the way of the drive wheels to effect removal. An actuator for the brake may be moved through the brake-applying position to an over-center position to effect the locking of the drive wheels so that the user can dismount from the wheelchair without fear of it moving during dismounting.

The front wheels have vertically extending spindles, or other shaft means, which are received in a split-block assembly attached to the frame. A graspable component for effecting rotation of the front wheels about a vertical axis is attached to each spindle. The chair is mounted by the pallet in such a manner that one sitting in the chair may readily grasp the steering components for the front wheels and effect steering of the wheelchair.

It is the primary object of the present invention to provide a lightweight, comfortable and easy-to-use wheelchair that may be folded compactly for ready transportation, and which is readily utilizable in wheelchair sports, and on the wheelchair. This and other objects of the invention will become clear from an inspection of the detailed description of the invention, and from the appended claims.

BRIEF DESCRIPTION OF THE DRAWINGS

FIG. 5 is a detailed cross-sectional view taken along lines 5—5 of FIG. 4 showing the interconnection between the pallet and frame;

FIG. 6 is a top plan view of the frame of the wheelchair of FIG. 4;

FIG. 7 is a top plan view of a portion of the pallet of the wheelchair of FIG. 4, in particular illustrating the details of the rods forming the chair;

DETAILED DESCRIPTION OF THE DRAWINGS

Figure 1:
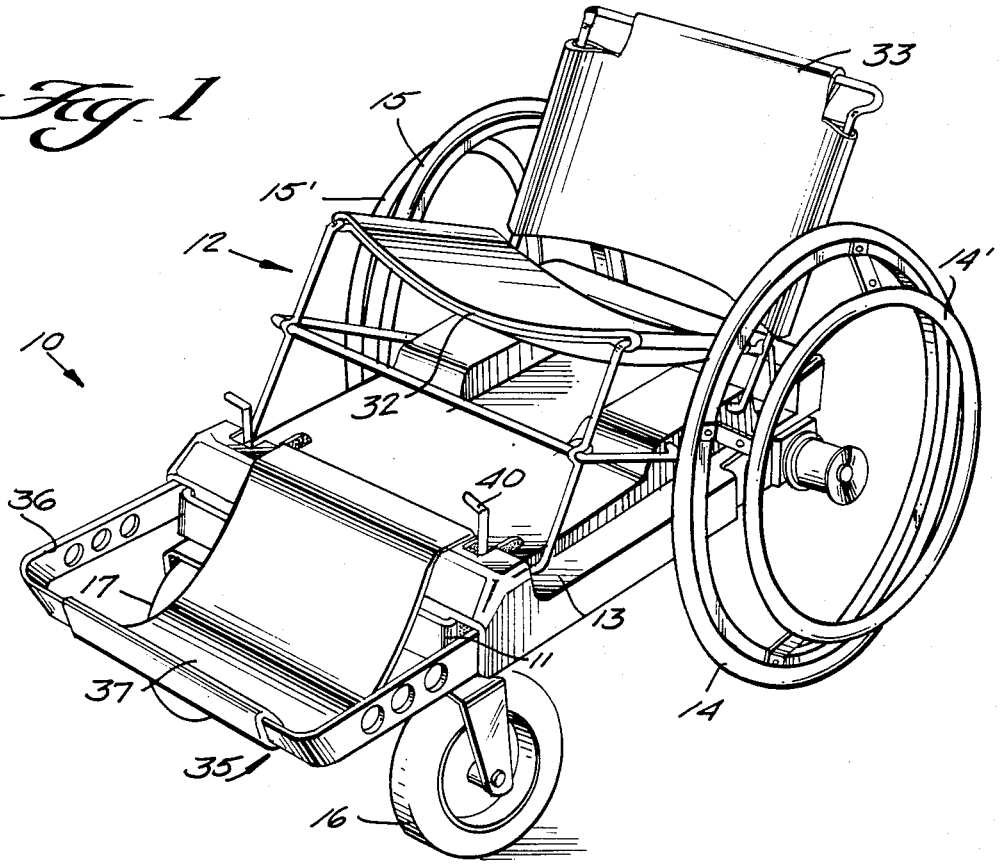
FIG. 1 is a perspective view of an exemplary wheelchair according to the present invention.

An exemplary wheelchair according to the present invention is shown generally by reference number 10 in FIG. 1. The major components of the wheelchair comprise the base frame 11, chair means 12, a chair support means or pallet 13, and a plurality of wheels mounted to the base frame 11, preferably including two rear drive wheels 14, 15, and two caster-type front wheels 16, 17. Means for propelling the drive wheels 14, 15 consist of conventional hand engagable rim means 14', 15' associated with the drive wheels 14, 15 respectively.

Figure 2:
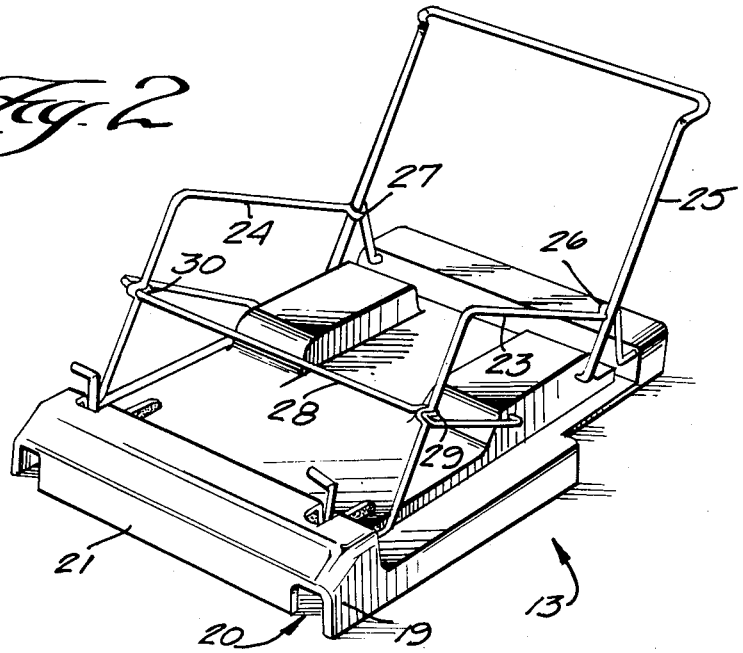
FIG. 2 is a perspective view of a component of the wheelchair of FIG. 1 with the chair shown in an erect position.
Figure 3:
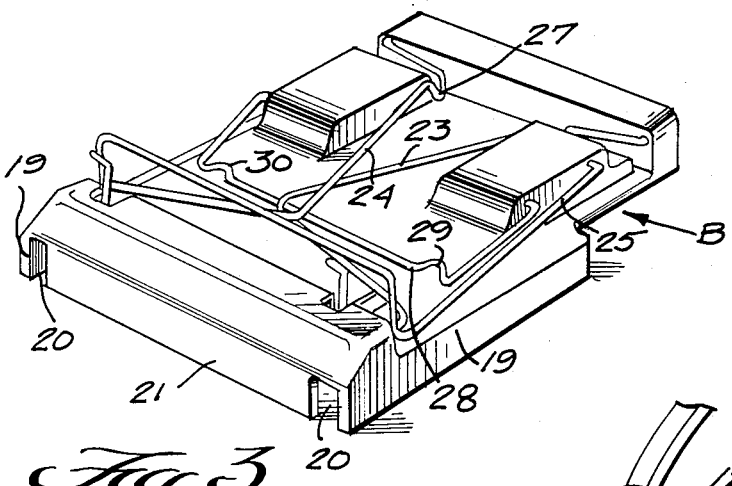
FIG. 3 is a view like that of FIG. 2 showing the chair in a collapsed configuration.

The pallet 13 has the configuration illustrated in FIGS. 1 through 3, including side lips 19 which are disposed over the sides of the frame 11, and with the front lip 21 define channels 20 for receipt of the sides of the frame 11. The pallet 11 is preferably molded of hard plastic, and is attached to the frame 11 by means (not shown) providing ready adjustability of the pallet 13 with respect to the frame 11, adjustment of the pallet 13 with respect to the frame 11 effecting adjustment of the center of gravity of the wheelchair 10.

In the embodiment illustrated in FIGS. 1 through 3, the chair means 12 comprise a first set of rods defining a seat portion, and a second set of rod portions defining a back portion. The seat portion is defined by rods 23, 24 which are each pivotally mounted at both ends thereof to portions of the pallet 13. The back portion comprises a rod 25 which is pivotally mounted at both ends thereof to the pallet 13. A U-shaped bend 26, 27 in each of the rods 23, 24 receives the back rod 25 to hold it in its erect configuration (FIGS. 1 and 2), while a locking means—defined by a locking rod 28—engages the seat-defining rods 23, 24 to hold them in the erect position. U-shaped bends 29, 30 formed in the locking rod 28 receive the upstanding portions of the rods 23, 24, and the rod 28 is pivotally mounted at both ends thereof to the pallet 13.

The collapsed configuration of the chair means 12 of FIGS. 1 and 2 is illustrated in FIG. 3, the rods when collapsed providing a generally flat configuration, facilitating ready transportation of the wheelchair.

Flexible components are connected between the seat defining and back-defining rods to allow the user to actually sit on the chair. Such flexible components are seen in FIG. 1, and comprise a first sheet of fabric 32 wrapped around opposite edges thereof which receive the rods 23, 24, with a back flexible component 33 wrapped around at two sides thereof for receipt of different portions of the back rod 25. The components 32, 33 preferably are formed of a durable fabric, and the closure thereof may be constructed with lacing or snap fasteners or the like to provide ready interchangeability of components. Being flexible, the components 32, 33 do not interfere with movement of the chair means 12 to the collapsed configuration illustrated in FIG. 3. While, for clarity of illustration, the components 32, 33 are not shown in FIG. 3, it is understood that the chair means 12 can be moved essentially to the configuration illustrated in FIG. 3 even with the components 32, 33 in place.

For the wheelchair 10 a foot support 35 is also provided. The foot support 35 includes a frame 36 which is bolted (not shown) to the pallet 13. A fabric heel rest 37 has a sleeve at one end thereof receiving a front part of frame 36, and is affixed (by means not shown) to the pallet 13 at the other end thereof. The sleeve in heel support fabric 37 may be formed by snap fasteners or the like for ready removability, and the heel support 37 may also be connected to the pallet 13 by snap fasteners or the like.

Figure 4:
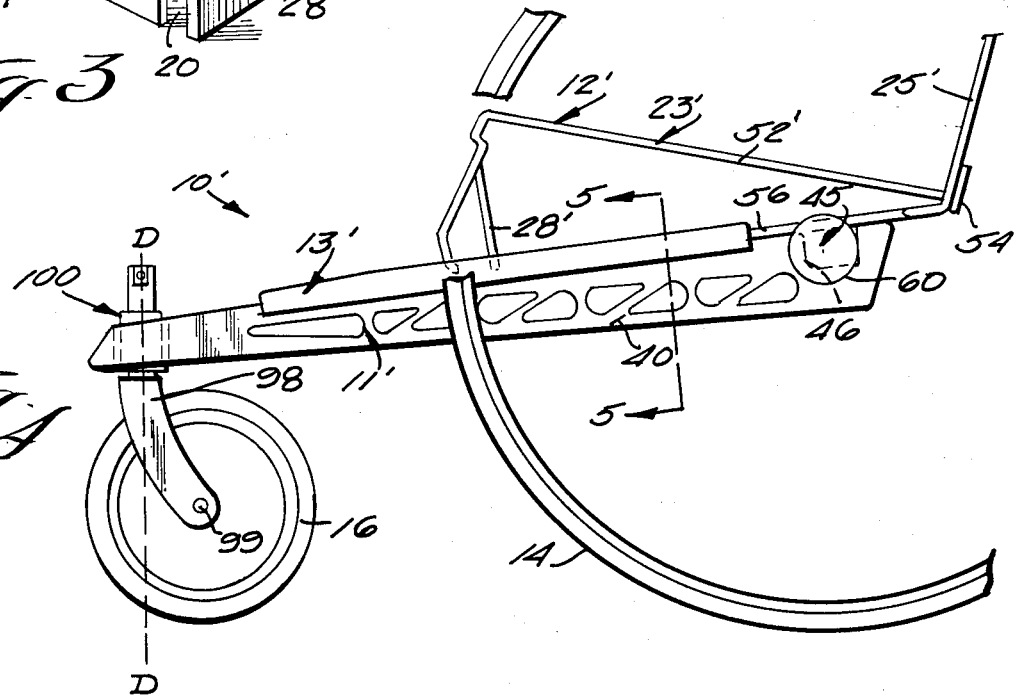
FIG. 4 is a side view of a modified configuration of an exemplary wheelchair according to the present invention.

Another configuration of a wheelchair according to the present invention is shown in FIGS. 4 through 7, being illustrated in FIG. 4 generally by reference numeral 10'. The wheelchair 10' is particularly designed for racing, or other wheelchair sports. Components of the FIGS. 4 through 7 embodiment identical to corresponding components in the FIGS. 1 through 3 embodiment are illustrated by the same reference numeral, while components performing generally the same function but having a different configuration are illustrated by the same reference numeral following by a "'".

As seen most clearly in FIGS. 4 through 6, the frame 11'—which is preferably formed of aluminum or a like lightweight metal—includes side plates 40, rear flange 41, front flange 42, and an interior web 43 interconnecting the components 40, 41, 42. The web 43 may be continuous or—in order to save weight—as illustrated in FIG. 6 may have cut-outs formed therein. Adjacent the side plates 40, a plurality of elongated slots 44 are formed in the web 43. The slots 44 are adapted to receive screws, or like fasteners, 45 (see FIG. 5) for attachment of the pallet 13' to the frame 11'. The web 43 also is configured at the rear thereof, adjacent rear flange 41, to define a channel 45 coincident with cutouts 46 in the side plates 40 for receipt of rear wheel mounting blocks, as will be hereinafter explained. At the front of the web 43, a pair of bores 47 are formed for receipt of vertically extending shaft means for the front wheels 16, 17.

An exemplary manner in which the pallet 13' is mounted on the frame 11' for longitudinal adjustability (to thereby adjust the center of gravity without moving the rear wheels vis-a-vis the frame) is illustrated most clearly in FIG. 5. The pallet 13' includes a side flange 19' overlapping one side of the side plate 40, and an interior flange component 48 overlapping the interior face of the side plate 40. Interiorly threaded holes 49 are formed at predetermined spaced locations along the bottom of the pallet 13' in registry with the slots 44 and for receipt of screws 45. By threading the screws 45 into the openings 49, and tightening them down, the position of the pallet 13' with respect to the frame 11' may be fixed. By simply loosening the screws 45, the pallet 13' can be slid with respect to the frame 11' until the end of travel defined by the front and rear of the slots 44 is reached, and the screws 45 may be tightened down in any position thereof vis-a-vis the slots 44. In the embodiment illustrated in the drawings, preferably four screws 45 and openings 49 are provided, two along each side of the pallet 13'.

The chair means 12' in the FIGS. 4–7 embodiment have a different configuration than the chair means 12 illustrated in FIGS. 1 through 3, but perform the same basic functions. Seat-defining rod 23' (there is an identical such rod on the opposite side of the pallet 13') includes a bottom portion 51 received by a collar 52 attached to the plastic pallet 13', and mounts the seat-defining 23' for pivotal movement with respect to the pallet 13'. The upper portion 52' of the rod 23', which portion receives the actual fabric component 32 or the like, is attached at the free end 53 thereof to the rod bottom portion 51, as by a weld. An outwardly extending flange portion 54 integral with the bottom rod portion 51 defines a stop for abutting the back-defining rod 25'. The back-defining rod 25' includes at each free end thereof an inwardly bent portion 56, including an end 57 received by a collar 58 integral with the pallet 13' so that it is pivotally mounted with respect to the pallet 13'. Under some circumstances, an extraneous locking component, such as a clamp, may be provided to releasably fix the portions 54 of each seat-defining rod to the back portion-defining rod 25'. Such an accessory locking component may be utilized with pivotally mounted locking rods 28' (only one shown in FIGS. 4 and 7) to hold the chair means 12' in its erect position.

Each of the drive wheels 14, 15 has a shaft means associated therewith for receipt by a frame-mounted component. The shaft means may comprise a bearing assembly, or may comprise spindle (with the bearing assembly for rotation of the wheels 14, 15 provided in the hubs of the wheels themselves). In their exemplary embodiment illustrated in the drawings, with particular reference to FIGS. 1, 4, and 9, the hub 60 of the rear wheel 14 includes a bearing assembly, with a spindle 61 extending therefrom; the bearing assembly and spindle may be generally of the type shown in U.S. Pat. No. 3,893,708.

Each drive wheel spindle 61 is received by a block 62 (see FIGS. 8 through 12) of steel or the like, the block 62 being operatively mounted to the frame 11'. For ease of removal of the rear wheels, the blocks 62 preferably are split-blocks having a shaft-receiving central passageway 63, and having lips 64 defining a channel 65 in communication with the passageway 63 and extending along substantially the entire length thereof, parallel to passageway 63. The axis of rotation A—A of each rear wheel received by a block 62 is thus a horizontal axis defined by the passageway 63, and generally (although not necessarily exactly) perpendicular to a side plate 40 of frame 11'.

Figure 8:
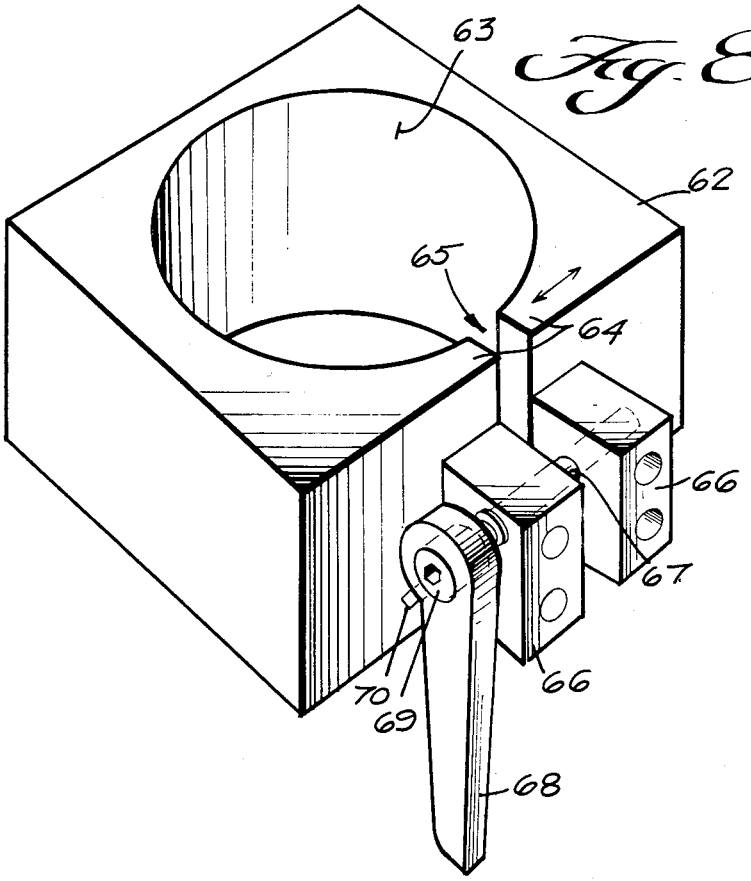
FIG. 8 is a perspective view of an exemplary split-block for mounting one of the rear wheels of the chair of FIG. 4.

Means are provided for adjusting the effective width of the channel 65, to thereby change the effective interior dimensions of the passageway 63, to effect either clamping or release of the spindle 61 by the passageway 63. Such an adjustment means may comprise—as illustrated in FIG. 8—a flange 66 of steel or the like extending parallel to the channel 65 on each side thereof, and fastener means, such as screw 67, associated with each of the flanges 66, with means—such as handle 68—for acting on the fastener means 67 to effect movement of the flanges 66 toward and away from each other. The screw 67 may have an Allen cap 69, and a set screw 70 may pass through the handle 68 in a direction perpendicular to the elongation of the screw 67 to engage the Allen cap 69. The flanges 66 are bolted, or otherwise attached, to the lips 64.

To adjust the clamping action of the split-block 62, one loosens the set screw 70 and tightens the screw 67, utilizing an Allen wrench engaging the cap 69, until the desired clamping dimensions of the passageway 63 are achieved. Then the handle 68 is positioned over the cap 69 in a desired orientation, and the set screw 70 is tightened so that it frictionally tightly engages the cap 69. Then by a 90 degree turn of the handle 68 the lips 64 may be moved from a clamping position to a release position, and vice-versa.

Figure 9:
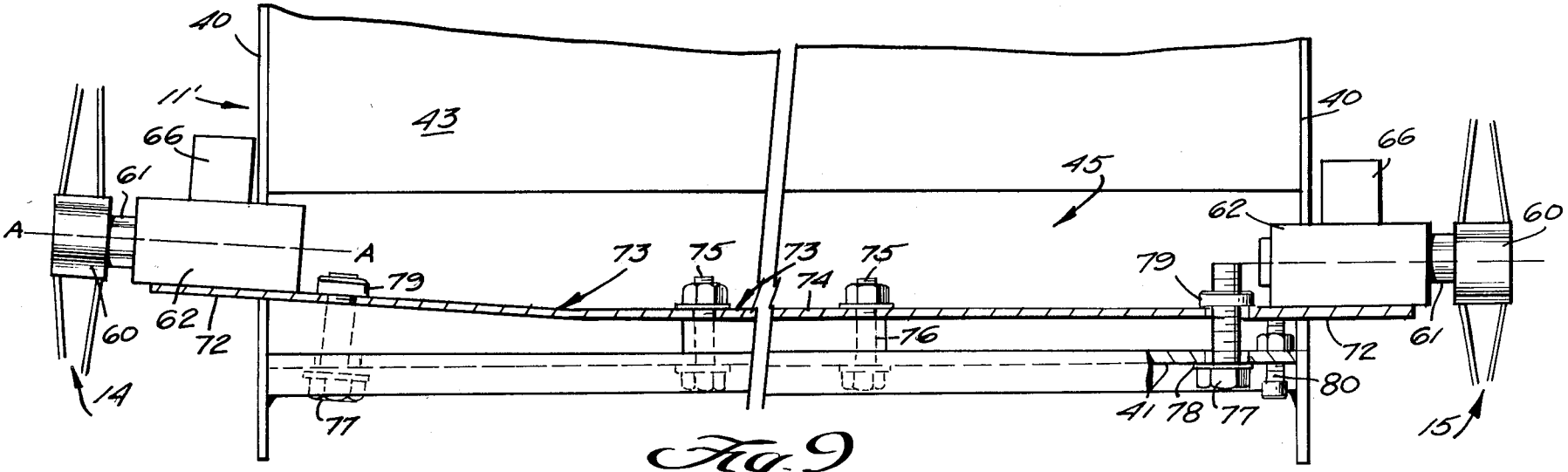
FIG. 9 is a top view, partly in cross-section and partly in elevation, of an exemplary manner of mounting the drive wheel-receiving blocks, showing the mechanism for toe adjustment thereof.

The blocks 62 are operatively mounted to the frame 11' in such a manner that the toe and camber of the rear wheels 14, 15 may be readily adjusted. The mechanism for mounting the blocks 62 primarily for effecting toe adjustment is illustrated in FIG. 9. The blocks 62 are mounted to free ends 72 of an elongated flexible member 73, which preferably comprises a metal leaf spring. A central portion 74 of the leaf spring 73 is clamped, as by bolts 75 acting through rigid blocks 76, to the rear flange 41 of the frame 11'. Toe adjustment is provided by flexing the ends 72 of the leaf spring 73 with respect to the stationary central portion 74 thereof. In FIG. 9 the left-hand block 62 is illustrated at one extreme position, while on the right-hand side the block 62 is illustrated near another extreme position.

Flexing action of the leaf spring 73 is precisely controlled by flexing-bolts 77 which extend through the rear flange 41 of the frame 11', with the head, or a washer 78, thereof abutting the flange 41, and with a nut 79 abutting leaf spring 73 adjacent the block 62. By tightening the bolt 77, the block 62 can be moved from the position illustrated on the left-hand side of FIG. 9 to the position illustrated on the right-hand side. In order to hold the leaf spring 73 in a position to which it has been flexed by the bolt 77, adjustable abutment means are provided. For simplicity of illustration only one such abutment means is illustrated in FIG. 9, although another one will be associated with the other bolt 77. The exemplary abutment means illustrated in FIG. 9 comprises a bolt 80 which also passes through the rear flange 41 of the frame 11'.

To adjust the toe of a rear wheel, the bolt 80 associated with that wheel is drawn out from the flange 41, the bolt 77 is rotated until the leaf spring 73 is flexed to the desired toe-position, and then the bolt 80 is tightened so that it abuts the opposite end of the leaf spring 73 as the nut 79.

Figure 10:
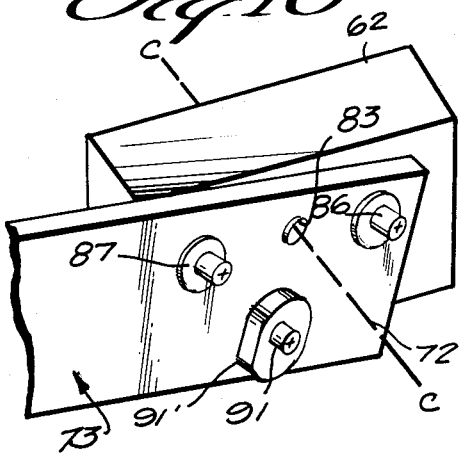
FIG. 10 is a detailed perspective view of the manner in which one of the blocks of FIGS. 8 and 9 is mounted to provide camber adjustment.
Figure 11:
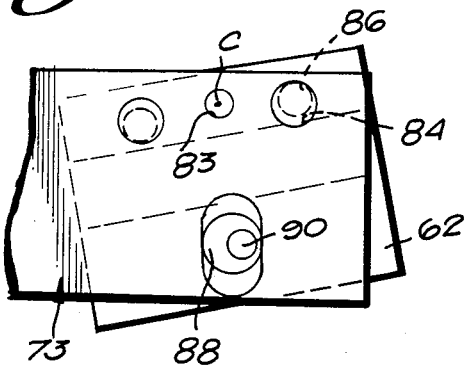
FIG. 11 is a plan view of the structure of FIG. 10 with various components removed for clarity of illustration.
Figure 12:
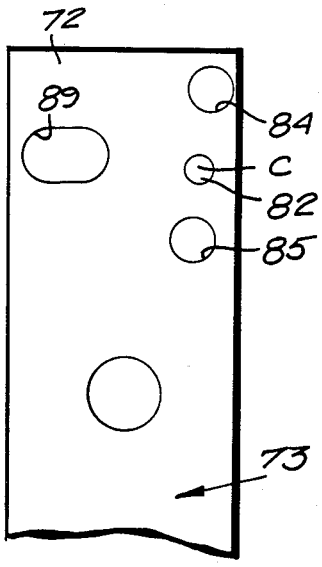
FIG. 12 is a plan view of one end of the leaf spring block-mounting structure of FIG. 9.

The manner of effecting camber adjustment of the rear wheels 14, 15 is best seen with respect to FIGS. 10 through 12. Each of the blocks 62 is mounted to the leaf spring 73 at or adjacent a free end 72 thereof for operative pivotal movement with respect to the frame 11' about an axis C—C substantially perpendicular to the drive wheel axis of rotation A—A, so that the camber of the rear wheels may be adjusted by operative pivotal movement of the blocks 62 with respect to the base frame 11'.

A preferred manner of providing for pivotal movement of the blocks 62 to effect camber adjustment is shown most clearly in FIGS. 10 through 12 wherein an opening 82 in leaf spring 73 is provided for receipt of a dowel pin 83 or the like which extends into the blocks 62, terminating short of the passageway 63, and defines the pivotal axis C—C. Openings 84, 85 are provided on either side of the opening 82 for receipt of the shafts of cap screws 86, 87, which extend into interiorly threaded openings (not shown) in the block 62. The holes 84, 85 are substantially larger than the cap screw shafts, as illustrated in FIG. 11, to allow for pivotal movement of the block 62 vis-a-vis the leaf spring 73. Actual pivotal movement is effected by the eccentric cam 88 disposed in elongated opening 89 in leaf spring 73, the cam 88 being connected to a shaft 90 extending into block 62, and having an Allen cap 91 thereon.

To effect camber adjustment of one of the rear wheels mounted by a block 62, the cap screws 86, 87 and 91 are loosened and then eccentric nut 91' is rotated, which in turn effects rotation of the eccentric 88 in the slot 89, causing the block 62 to pivot about dowel pin 83 (and axis C—C). Preferably the openings 84, 85, etc. are dimensioned so that a deviation of about 10 degrees from either side of a true in-line position of the block 62 with respect to the leaf spring 73 may be provided. Once the block 62 has been moved to the position providing the desired camber, the cap screws 86, 87 and 91 are again tightened down.

Figure 14:
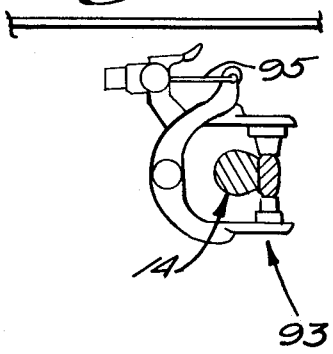
FIG. 14 is a top view, partly in cross-section and partly in elevation, taken along lines 14—14 of FIG. 13, showing the brake mechanism.
Figure 13:
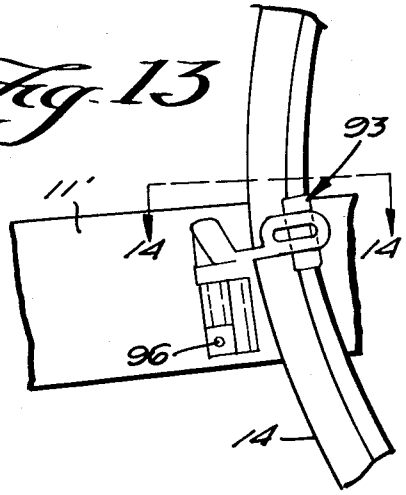
FIG. 13 is a side detailed view of a rear wheel brake mechanism utilizable with the wheelchair of FIG. 4.

In order to provide for braking of the wheelchair, a conventional caliper brake 93, or the like (see FIGS. 13 and 14) is associated with the rim of one or both of the rear wheels 14, 15. As is conventional, the caliper brake is actuated by a Bodwen cable 95, and the actuating lever for the Bodwen cable 95 may be positioned any place desirable on the frame 11', pallet 13', or chair rods 23, 23', etc. An actuating lever (not shown) may be provided associated with the Bodwen cable 95 that allows the lever to move continuously from a non-braking position, to a braking position, to an over center position locking the caliper brake 93 into braking relationship with the wheels 14, 15. An exemplary type of operating lever that may be utilized is shown in U.S.

Pat. No. 3,679,257, the disclosure of which is hereby incorporated by reference herein.

According to the present invention, the brake 93 is mounted so that it does not interfere with ready removal of the rear wheels. This is accomplished by mounting the entire caliper brake assembly 93 for pivotal movement about a pivot pin 96 which extends parallel to the axis of rotation A—A of the rear wheel with which it is associated, and is radially exterior of the rear wheel. Any suitable conventional locking mechanism may be provided for holding the brake assembly 93 in the position illustrated in FIGS. 13 and 14. By pivotal movement about pivot pin 96, the entire brake assembly 93 can be moved out of association with the wheel 14 so that the entire wheel 14 can be removed from the wheelchair by pulling outwardly in the direction of axis A—A.

Figure 15:
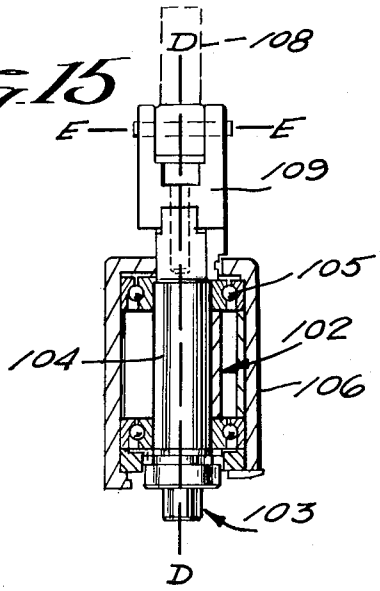
FIG. 15 is a side view, partly in cross-section and partly in elevation, of an exemplary front wheel mounting component for the wheelchair of FIG. 4.

The front wheels preferably are caster-type wheels, having a yoke 98 (see FIG. 4) straddling the sides of the wheel and pivotal about a horizontal axle 99. A vertical shaft means 100 extends upwardly through the frame 11', and defines a vertical axis of rotation D—D of the wheel 16 with respect to the frame 11'. The shaft means 100 may be a spindle, or a bearing assembly, but preferably comprises a bearing assembly 102 as illustrated in FIG. 15. The yoke 98 is affixed to the bottom portion 103 of a central shaft 104 defining axis D—D, with ball bearings 105 and the like extending between the central shaft 104 and an outer casing 106. The outer casing 106 is received within a split-block assembly, much like the split-block assembly 62, which is mounted in the opening 47 in the frame 11'.

In order to effect steering of the wheelchair 10', especially when used for wheelchair sports and the like, a manually graspable steering component 108 is mounted to the central shaft 104 of the assembly 100. Preferably the component 108 comprises a lever pivotally mounted to a top cap 109 on the shaft 104 for rotation about a horizontal axis E—E generally parallel to the axis defined by axle 99, for movement from a normal operating position (solid line in FIG. 15) essentially perpendicular to the central shaft 104, to the position illustrated in dotted line of FIG. 15 wherein it is essentially in-line with the shaft 104. In the dotted line position in FIG. 15, the lever 108 does not interfere with removal of the assembly 100 from the frame 11'.

As seen in FIG. 4, the chair means 12' are mounted to the chair support 13' and the frame 11' so that an individual sitting on the chair can with his/her hand easily reach and operate the levers 108 while seated.

Figure 16:
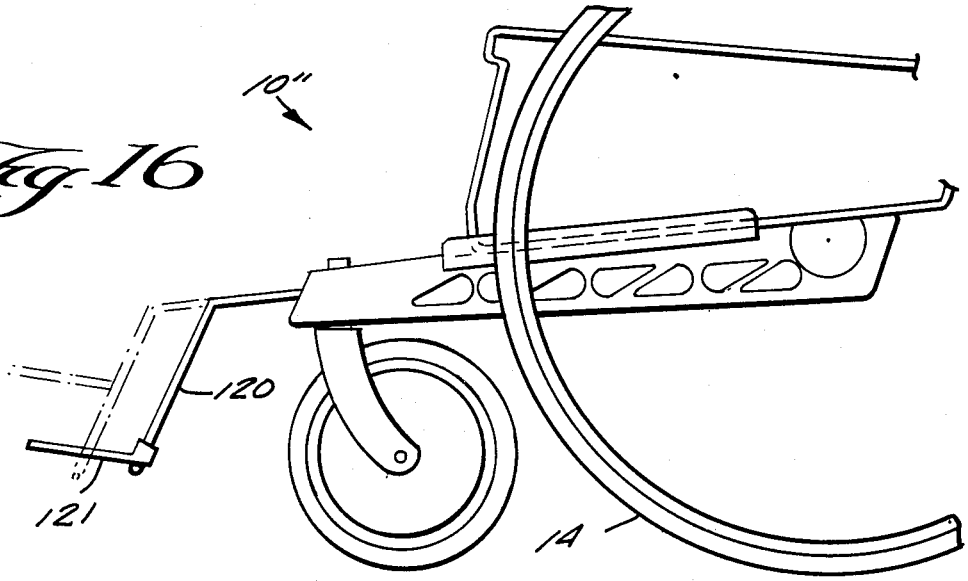
FIG. 16 is a side view of another modified form of wheelchair according to the present invention.

Another modification of a wheelchair (primarily for "street" use) according to the present invention is shown generally by reference numeral 10'' in FIG. 16. This wheelchair is essentially the same as the wheelchair 10' except for the relative dimensions of components, such as the length of the frame, the wheelbase, the height of the chair seat portion, etc. Also in this embodiment a foot support is provided comprising a pair of rods 120 bolted, or otherwise attached, to the front plate 42 of the frame, with a heel support 121 adjustably positioned on the rod 120 to adjust the height thereof, and the pivotal position thereof with respect to the rod 120.

Operation

An exemplary manner of utilization of a wheelchair 10' according to the present invention will now be described with particular reference to FIGS. 4 through 15.

The wheelchair is placed in an operative mode by placing the pallet 13' on the frame 11' and adjusting the position thereof with respect to the frame 11' so that the desired center of gravity is achieved. Then the screws 45 are tightened to hold the pallet 13' in place with respect to the frame 11'. The chair means 12' is unfolded by pivoting the seat-portion defining rods (e.g. 23') with respect to the pallet 13' to the erect configuration, pivoting the back-portion defining rod 25' with respect to the pallet 13' until it abuts the rod portion 54, pivoting the locking rods (e.g. 28') to a position abutting the seatportion defining rods, and utilizing an accessory clamp between rod 25' and flange portion 54 where they engage (if such an accessory clamp is necessary or desirable). Then the fabric components 32, 33 are placed in operative association with the rods 23', 25' to define the wheelchair seat.

The rear wheels 14, 15 are moved into operative association with the frame 11'. Blocks 62 and leaf spring 73 are already operatively attached to the frame 11', the blocks 62 being received by channel 45 in frame 11'. The spindle 61 associated with each rear wheel is passed through the central passageway 63 of the block 62, and the handle 68 is rotated to the clamping position. The handle 68 may be removed after clamping if desired. The graspable steering lever 108 associated with each of the front wheels is moved to the position in-line with the central shaft component 104 (see dotted line configuration in FIG. 15), and the entire shaft means 100 is passed vertically upward through a split-block into mounting association with the frame 11'. The split-block is then locked in place.

The toe and camber of the rear wheels 14, 15 is adjusted depending upon the particular use to which the wheelchair 10' is to be put, the physiology and condition of the user, etc. The toe is adjusted by acting upon bolts 77, 80 associated with each block 62 (see FIG. 9), which effects a slight longitudinal movement of block 62 vis-a-vis the frame 11', but only for toe adjustment. Camber is adjusted by loosening the cap screws 86, 87 associated with the block 62, rotating eccentric cam 91' until the block 62 is in the desired position, and then retightening the screws 86, 87.

It will thus be seen that according to the present invention a versatile, comfortable, and easy-to-use wheelchair has been provided. The wheelchair is capable of being folded compactly for transportion in a car or airplane, and is lightweight. The wheelchair is versatile, and is especially suited for use in wheelchair sports, such as wheelchair racing. The center of gravity may be readily and quickly adjusted without adjusting the wheelbase, and the toe and camber of the drive wheels is also easily adjusted.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A wheelchair comprising:

a base frame;

a plurality of wheels including two drive wheels and at least one other wheel;

means for mounting said wheels to said base frame;

chair means including a seat portion and a back portion;

a chair support means comprising a molded plastic pallet;

means for mounting said chair means to said support means; and means for readily releasably mounting said support means to said base frame.

2. A wheelchair as recited in claim 1 wherein said frame comprises a pair of side plates and a web extending between said side plates; and wherein said means for mounting said chair support means to said frame comprises a pair of inner and outer flanges of said chair means for receipt of each of said frame side plates; means defining elongated openings in said web adjacent each of said side plates; and fastener means extending through said elongated openings into operative association with said chair support means.

3. A wheelchair as recited in claim 1 wherein said means for mounting said drive wheels to said base frame comprises: a separate shaft means operatively attached to each of said drive wheels and defining an axis of rotation of said drive wheels; a block operatively mounted to said base frame for receipt of each of said shaft means; and means for operatively mounting each of said blocks to said base frame for operative pivotal movement with respect to said base frame about an axis substantially perpendicular to its respective drive wheel axis of rotation, so that the camber of said rear wheels may be adjusted by operative pivotal movement of said blocks with respect to said base frame, and without adjustment of the wheelbase of said wheelchair.

4. A wheelchair comprising:

a base frame comprising a pair of side plates and a web extending between said side plates;

a plurality of wheels including two drive wheels and at least one other wheel;

means for propelling said drive wheels, said means consisting of hand engagable rim means associated with said drive wheels;

means for mounting said wheels to said base frame so that they are rotatable with respect to said frame, but so that the wheelbase thereof is substantially fixed;

chair support means; and means for mounting said chair support means to said frame so that the position of said chair support means with respect to said frame and with respect to said drive wheels is adjustable, so that the center of gravity of said wheelchair is adjustable by adjusting the portion of said chair support means with respect to said frame, and without adjustment of the position of said drive wheels with respect to said frame, said means comprising: a pair of inner and outer flanges of said chair means for receipt of each of said frame side plates; means defining elongated openings in said web adjacent each of said side plates; and fastener means extending through said elongated openings into operative association with said chair support means.

5. A wheelchair as recited in claim 4 wherein said chair support means comprises a molded plastic pallet.

6. A wheelchair as recited in claim 4 wherein said drive wheels are rear wheels, and said at least one other wheel comprises two front wheels.

7. A wheelchair comprising:

a base frame;

a plurality of wheels including at least two rear wheels and at least one front wheel;

chair means;

support means for supporting said chair means on said base frame; and said chair means comprising a chair frame formed of rods including a first set of rods defining a chair seat portion and operatively pivotally mounted for movement with respect to said support means; and a second set of rod portions defining a chair back portion and operatively pivotally mounted for movement with respect to said support means; said rods pivotally movable from a first, erected, configuration and position defining a chair, to a second, collapsed, generally flat configuration and position with respect to said support means.

8. A wheelchair as recited in claim 7 further comprising locking means for locking said rods in said erect position.

9. A wheelchair as recited in claim 7 further comprising a flexible component operatively connected to each of said first and said second sets of rods to define with said rods said chair seat and back portions, respectively, said flexible components not interfering with pivotal movement of said rods with respect to said support means.

10. A wheelchair comprising:

a base frame;

two drive wheels and at least one other wheel; means for mounting said drive wheels to said base frame, said means comprising a separate shaft means operatively attached to each of said drive wheels and defining an axis of rotation of said drive wheels, and a block operatively mounted to said base frame for receipt of each of said shaft means;

means for operatively mounting each of said blocks to said base frame for operative pivotal movement with respect to said base frame about an axis substantially perpendicular to its respective drive wheel axis of rotation, so that the camber of said rear wheels may be adjusted by operative pivotal movement of said blocks with respect to said base frame, said means comprising pin means associated with each block; and means for effecting pivotal movement of said blocks with respect to said frame, said means comprising for each block an eccentric cam rotatable about an axis spaced from and parallel to said pin means, and an elongated slot receiving said eccentric cam; one of said cam and said slot being operatively associated with said frame, and the other of said cam and said slot being operatively associated with said block.

11. A wheelchair as recited in claim 10 further comprising means for operatively mounting said blocks to said frames for effecting independent limited longitudinal movement of each of said blocks along a path generally coincident with said axis of rotation of said blocks so that the toe of said drive wheels may be adjusted by said limited longitudinal movement.

12. A wheelchair as recited in claim 10 wherein said shaft means comprises a spindle.

13. A wheelchair as recited in claim 10 wherein each said block has means defining a shaft means-receiving central passage therein, and a channel formed in said block in communication with said central passage and extending along substantially the entire length of said block parallel to said central passage; and further comprising means for adjusting the effective width of said channel to change the effective interior dimensions of said passageway to thereby effect either clamping, or release, of said shaft means by said passageway, said means for adjusting the effective width of said channel comprising: a flange extending substantially parallel to said channel on each side of said channel; fastener means operatively associated with each of said flanges; and means for acting on said fastener means to effect movement of said flanges toward and away from each other.

14. A wheelchair as recited in claim 11 wherein said means for mounting said blocks for toe adjustment comprises: an elongated flexible member; means for fixedly mounting a central portion of said elongated flexible member to said frame, with free ends of said elongated flexible member extending outwardly from said central portion;

said blocks pivotally mounted to said free ends of said elongated flexible member; and adjustable flexing means operatively mounted between said frame and said free ends of said elongated flexible member to effect limited flexing of said elongated flexible member free ends with respect to said stationary central portion thereof so that each free end thereof moves in a path generally coincident with a respective axis of rotation of a said block; and wherein each said eccentric cam is pivotally mounted to a said block, and said elongated slot associated with each cam is formed in said flexible member.

15. A wheelchair comprising:

a base frame;

a plurality of wheels including two drive wheels and at least one other wheel, said wheels operatively mounted to said frame;

said drive wheels each including shaft means defining an axis of rotation thereof;

a block for receiving said shaft means; and means for operatively mounting said blocks to said base frame so that said blocks are mounted for limited movement along a path generally perpendicular to the axis of rotation of a rear wheel, so that the toe of each of said rear wheels may be adjusted, said means comprising: an elongated flexible member; means for fixedly mounting a central portion of said elongated flexible member to said frame, with free ends of said elongated flexible member extending outwardly from said central portion; said blocks pivotally mounted to said free ends of said elongated flexible member; and adjustable flexing means operatively mounted between said frame and said free ends of said elongated flexible member to effect limited flexing of said elongated flexible member free ends with respect to said stationary central portion thereof so that each free end thereof moves in a path generally coincident with a respective axis of rotation of a said block.

16. A wheelchair as recited in claim 15 wherein said drive wheels are rear wheels, and said at least one other wheel comprises two front wheels.

17. A wheelchair as recited in claim 15 wherein each said block has means defining a shaft means-receiving central passage therein, and a channel formed in said block in communication with said central passage and extending along substantially the entire length of said block parallel to said central passage; and further comprising means for adjusting the effective width of said channel to change the effective interior dimensions of said passageway to thereby effect either clamping, or release, of said shaft means by said passageway, said means for adjusting the effective width of said channel comprising: a flange extending substantially parallel to said channel on each side of said channel; fastener means operatively associated with each of said flanges; and means for acting on said fastener means to effect movement of said flanges toward and away from each other.

18. A wheelchair comprising:

a base frame;

a pair of rear, drive wheels operatively mounted to said base frame;

at least one front wheel operatively mounted to said base frame;

chair means, including a seat portion and a back portion, operatively mounted to said base frame; and caliper brake means mounted in operative association with said frame for effecting braking of said rear wheels;

said brake means including means for mounting said brake means for rotation about an axis radially exterior of said rear wheels, and generally parallel to the axis of rotation of said rear wheels, so that said brake means may be moved to an inoperative position allowing ready removal of said rear wheels from association with said frame.

19. A wheelchair comprising:

a base frame comprising a pair of side plates and a web extending between said side plates;

a plurality of wheels including two drive wheels and at least one other wheel;

means for mounting said wheels to said base frame;

chair means including a seat portion and a back portion;

a chair support means;

means for mounting said chair means to said support means;

means for readily releasably mounting said chair support means to said base frame, comprising: a pair of inner and outer flanges of said chair means for receipt of each of said frame side plates; means defining elongated openings in said web adjacent each of said side plates; and fastener means extending through said elongated openings into operative assocaition with said chair support means.

* * * * *